US012258761B2

(12) United States Patent
Willits et al.

(10) Patent No.: US 12,258,761 B2
(45) Date of Patent: Mar. 25, 2025

(54) ROOFING SYSTEM HAVING TAPERED INSULATION PANELS, A ROOF ASSEMBLY KIT AND A METHOD OF INSTALLING THEREOF

(71) Applicant: BMIC LLC, Dallas, TX (US)

(72) Inventors: James Willits, Fort Worth, TX (US); Venkata Nagarajan, Hawthorn Woods, IL (US); Andrew Seymour, Dallas, TX (US); Mark Lienemann, Stillwater, MN (US); David Scott, Dallas, TX (US); Walter Brown, Dallas, TX (US); Leonel Alvarado, Dallas, TX (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/639,117

(22) Filed: Apr. 18, 2024

(65) Prior Publication Data

US 2024/0352739 A1 Oct. 24, 2024

Related U.S. Application Data

(60) Provisional application No. 63/496,975, filed on Apr. 19, 2023.

(51) Int. Cl.
*E04D 13/16* (2006.01)
*E04D 5/00* (2006.01)

(52) U.S. Cl.
CPC ..... *E04D 13/1693* (2013.01); *E04D 5/00* (2013.01)

(58) Field of Classification Search
CPC ..... E04D 13/1693; E04D 5/00
See application file for complete search history.

(56) References Cited

U.S. PATENT DOCUMENTS 4,530,193 A * 7/1985 Ochs ..... E04D 13/0477 52/309.8
4,642,950 A * 2/1987 Kelly ..... E04D 13/1693 52/90.2
2008/0163586 A1* 7/2008 Goulet ..... E04C 2/243 52/794.1

(Continued)

FOREIGN PATENT DOCUMENTS

DE 0403925 A1 * 12/1990
DE 4124109 A1 * 1/1992

(Continued)

OTHER PUBLICATIONS

Construction Canada: "How tapered insulation can eliminate ponding on low-slope roofs", Apr. 14, 2021 (Apr. 14, 2021), pp. 1-7, Retrieved from the Internet: URL: https://www.constructioncanada.net/how-tapered-insulation-can-eliminate-ponding-on-low-slope-roofs/ [retrieved on May 16, 2024].

*Primary Examiner* — Adriana Figueroa
(74) *Attorney, Agent, or Firm* — Venable LLP

(57) ABSTRACT

This invention, in embodiments, relates to a roofing system that includes a roof deck, a plurality of tapered insulation panels applied onto the roof deck, at least one non-tapered insulation panel applied onto the plurality of tapered insulation panels, and a membrane layer applied onto the at least one non-tapered insulation panel. This invention, in embodiments, further relates to a roof assembly kit that includes a plurality of tapered insulation panels and instructions for installation, as well as a method of installing such a roofing system.

11 Claims, 9 Drawing Sheets

(56) References Cited

U.S. PATENT DOCUMENTS

| | | | | |
|---|---|---|---|---|
| 2010/0031593 | A1* | 2/2010 | Klose | E04D 13/1693<br>52/309.13 |
| 2010/0139194 | A1 | 6/2010 | Burns | |

FOREIGN PATENT DOCUMENTS

| | | | | |
|---|---|---|---|---|
| DE | 9213220 | U1 * | 1/1993 | |
| DE | 4441646 | A1 * | 6/1996 | E04D 11/00 |
| DE | 202019004335 | U1 * | 8/2020 | |
| EP | 3438367 | A1 | 2/2019 | |
| EP | 3438370 | A1 * | 2/2019 | E04D 13/1693 |
| FR | 3073873 | A1 * | 5/2019 | |

* cited by examiner

| PHYSICAL CHARACTERISTICS | | SHIPPING INFORMATION (4' X 4') (1.21 M X 1.21 M) | | | | |
|---|---|---|---|---|---|---|
| SLOPE | THICKNESS | SIZE* | BDS/ BUNDLE | BDS/ TRUCK | BUNDLES/ TRUCK | SQ. FT. PER TRUCK |
| 1/8:12 | .5"-1" (12.7 mm - 25.4 mm) | AA | 64 | 3,072 | 48 | 49,152 (4,566 sq. m) |
| | 1"-1.5" (25.4 mm - 38.1 mm) | A | 38 | 1,824 | 48 | 29,184 (2,711 sq. m) |
| | 1.5"-2" (38.1 mm - 51 mm) | B | 26 | 1,248 | 48 | 19,968 (1,855 sq. m) |
| | 2"-2.5" (51 mm - 64 mm) | C | 20 | 960 | 48 | 15,360 (1,427 sq. m) |
| | 2.5"-3" (64 mm - 76 mm) | D | 16 | 768 | 48 | 12,288 (1,142 sq. m) |
| | 3"-3.5" (76 mm - 89 mm) | E | 14 | 672 | 48 | 10,752 (999 sq. m) |
| | 3.5"-4" (89 mm - 102 mm) | F | 12 | 576 | 48 | 9,216 (856 sq. m) |
| 1/4:12 | .5"-1.5" (12.7 mm - 38.1 mm) | X | 48 | 2,304 | 48 | 36,864 (3,425 sq. m |
| | 1.5"-2.5" (38.1 mm - 64 mm) | Y | 24 | 1,152 | 48 | 18,432 (1,712 sq. m) |
| | 2.5"-3.5" (64 mm - 89 mm) | Z | 16 | 768 | 48 | 12,288 (1,142 sq. m) |
| | 1"-2" (25.4 mm - 51 mm) | G | 32 | 1,536 | 48 | 24,576 (2,283 sq. m) |
| | 2"-3" (51 mm - 76 mm) | H | 19 | 912 | 48 | 14,592 (1,356 sq. m) |
| | 3"-4" (76 mm - 102 mm) | I | 12 | 576 | 48 | 9,216 (856 sq. m) |
| 1/2:12 | .5"-2.5" (12.7 mm - 64 mm) | Q | 32 | 1,536 | 48 | 24,576 (2,283 sq. m) |
| | 1"-3" (25.4 mm - 76 mm) | XX | 22 | 1,056 | 48 | 16,896 (1,570 sq. m) |

*FIG. 5*

INSULATION ATTACHMENT TABLE - MECHANICALLY ATTACHED SYSTEMS
(MEETS FM ATTACHMENT REQUIREMENTS[1])

MECHANICALLY ATTACHED SYSTEMS

| NUMBER OF FASTENERS | | | | | |
|---|---|---|---|---|---|
| INSULATION TYPE | BOARD SIZE | THICKNESS | FASTENERS/BOARD | | |
| | | | FIELD | PERIMETER | CORNER |
| POLYISO | 4'x4' (1.2 m x 1.2 m) | any | 4 | 4 | 4 |
| | 4'x8' (1.2 m x 2.4 m) | 1/2" - 1.2" (13 mm - 30 mm) | 6 | 6 | 6 |
| | 4'x8' (1.2 m x 2.4 m) | ≥1.3" (33 mm) | 5 | 5 | 5 |
| PERLITE | 4'x4' (1.2 m x 1.2 m) | any | 4 | 4 | 4 |
| WOOD FIBER | 4'x4' (1.2 m x 1.2 m) | any | 4 | 4 | 4 |
| | 4'x8' (1.2 m x 2.4 m) | any | 6 | 6 | 6 |
| EXTRUDED POLYSTYRENE[3] | 4'x4' (1.2 m x 1.2 m) | any | 4 | 4 | 4 |
| | 4'x8' (1.2 m x 2.4 m) | 1/2" - 1.2" (13 mm - 30 mm) | 6 | 6 | 6 |
| | 4'x8' (1.2 m x 2.4 m) | ≥1.3" (33 mm) | 5 | 5 | 5 |
| EXPANDED POLYSTYRENE[3] | 4'x4' (1.2 m x 1.2 m) | any | 4 | 4 | 4 |
| | 4'x8' (1.2 m x 2.4 m) | 1/2" - 1.2" (13 mm - 30 mm) | 6 | 6 | 6 |
| | 4'x8' (1.2 m x 2.4 m) | ≥1.3" (33 mm) | 5 | 5 | 5 |
| FANFOLD - TPO OR FLEECE- BACK PVC ONLY | FANFOLD[2] | 3/8" min (10 mm) | 2-1-2-1-2 | 2-1-2-1-2 | 2-1-2-1-2 |
| GYPSUM BOARD[4] | 4'x8' (1.2 m x 2.4 m) | 1/4" - 5/8" (6 mm - 16 mm) | 6 | 6 | 6 |

FIG. 6A

INSULATION ATTACHMENT TABLE - ADHERED SYSTEMS

ADHERED SYSTEMS

| NUMBER OF FASTENERS | | | | | | | | |
|---|---|---|---|---|---|---|---|---|
| INSULATION TYPE | BOARD SIZE | THICKNESS | STANDARD ATTACHMENT FASTENERS/BOARD | | | ATTACHMENT FASTENERS/BOARD FOR 90 PSF UPLIFT RESISTANCE | | |
| | | | FIELD | PERIMETER | CORNER | FIELD | PERIMETER | CORNER |
| POLYISO | 4'x4' (1.2 m x 1.2 m) | 1" - 1.4" (25 mm x 35.5 mm) | 8 | 12 | 16 | | | |
| | 4'x4' (1.2 m x 1.2 m) | 1.5" - 1.9" (38 mm x 48 mm) | 6 | 8 | 12 | 8 | 12 | 16 |
| | 4'x4' (1.2 m x 1.2 m) | 2" (52 mm) MINIMUM | 4 | 6 | 8 | 4 | 6 | 8 |
| | 4'x8' (12m x 2.4m) | .5" - 1.4" (13 mm x 36 mm) | 16 | 24 | 32 | | | |
| | 4'x8' (1.2 m x 2.4 m) | 1" - 1.4" (25 mm x 35.5 mm) | 16 | 24 | 32 | | | |
| | 4'x8' (1.2 m × 2.4 m) | 1.5" - 1.9" (38 mm x 48 mm) | 11 | 16 | 22 | 16 | 24 | 32 |
| | 4'x8' (1.2 m x 2.4 m) | 2" (52 mm) MINIMUM | 8 | 12 | 16 | 8 | 12 | 16 |
| EPS/XPS[1] | 4'x4' (1.2 m x 1.2 m) | 1" - 1.4" (25 mm x 35.5 mm) | 8 | 12 | 16 | | | |
| | 4'x4' (1.2 m x 1.2 m) | 1.5" - 1.9" (38 mm x 48 mm) | 6 | 8 | 12 | | | |
| | 4'x4' (1.2 m x 1.2 m) | 2" (52 mm) MINIMUM | 4 | 6 | 8 | | | |
| | 4'x8' (1.2 m x 2.4 m) | 1" - 1.4" (25 mm x 35.5 mm) | 16 | 24 | 32 | | | |
| | 4'x8' (1.2 m x 2.4 m) | 1.5" - 1.9" (38 mm x 48 mm) | 11 | 16 | 22 | | | |
| | 4'x8' (1.2 m x 2.4 m) | 2" (52 mm) MINIMUM | 8 | 12 | 16 | | | |
| GYPSUM BOARD | 4'x8' (1.2 m x 2.4 m) | 1/4" - 5/8" (6 mm x 16 mm) | 16 | 24 | 32 | | | |
| | 4'x8' (1.2 m x 2.4 m) | 1/2" (12 mm) MINIMUM | 16 | 24 | 32 | 21 | 32 | 42 |
| WOPOOD FIBER | 4'x4' (1.2 m x 1.2 m) | 1/2" (12 mm) MINIMUM | 6 | 8 | 12 | | | |
| | 4'x4' (1.2 m x 1.2 m) | 1" (25 mm) MINIMUM | 4 | 6 | 8 | | | |
| | 4'x8' (1.2 m x 2.4 m) | 1/2" (12 mm) MINIMUM | 16 | 24 | 32 | | | |

FIG. 6B

ROOFING SYSTEM HAVING TAPERED INSULATION PANELS, A ROOF ASSEMBLY KIT AND A METHOD OF INSTALLING THEREOF

This application claims the priority of U.S. provisional application Ser. No. U.S. 63/496,975 entitled "A Roofing System Having Tapered Insulation Panels, a Roof Assembly Kit and a Method of Installing Thereof" filed Apr. 19, 2023, which is incorporated herein by reference in its entirety for all purposes.

FIELD OF THE INVENTION

This invention relates to a roofing system having buried or tapered insulation panels, a roof assembly kit, and a method of installing such a roofing system. A roofing system and an installation method is provided that includes tapered and non-tapered insulation panels to improve ease of installation, cost, and speed without compromising the performance of the roofing system.

BACKGROUND OF THE INVENTION

Currently, roof installers install tapered insulation panels (e.g., polyisocyanurate (ISO) foam panels) or boards sandwiched between a top layer of a single-ply membrane (e.g., a TPO or PVC membrane) and a bottom layer of a non-tapered insulation panel(s) or board(s), to meet the insulation and overall performance requirements of roof systems. This current method requires a significant amount of additional fasteners and labor to install. There is thus a need for a roofing system and an installation method that involves tapered and non-tapered insulation panels that improves ease of installation, reduces materials (e.g., required fasteners), and reduces labor costs, without compromising the system performance (e.g., fully adhered systems) and/or the warranty of the system.

SUMMARY OF THE INVENTION

One embodiment of this invention pertains to a roofing system that includes a roof deck, a plurality of tapered insulation panels applied onto the roof deck, with the plurality of tapered insulation panels having an upper surface and a lower surface, at least one non-tapered insulation panel applied onto the upper surface of the plurality of tapered insulation panels, with the at least one non-tapered insulation panel having an upper surface and a lower surface, with the lower surface of the at least one non-tapered insulation panel being applied onto the upper surface of the plurality of tapered insulation panels, and a membrane layer applied onto the upper surface of the at least one non-tapered insulation panel, the membrane layer having an upper surface and a lower surface, with the lower surface of the membrane layer being applied onto the upper surface of the at least one non-tapered insulation panel, wherein the roofing system is applied in accordance with instructions for installation, such that (i) the plurality of tapered insulation panels are applied onto the roof deck, (ii) the at least one non-tapered insulation panel is applied onto the upper surface of the plurality of tapered insulation panels, and (iii) the membrane layer is applied onto the upper surface of the at least one non-tapered insulation panel, such that the upper surface of the membrane layer is exposed.

In one embodiment, the membrane layer comprises at least one of (i) a single-ply TPO membrane, (ii) a single-ply PVC membrane, (iii) an ethylene propylene diene terpolymer membrane (EPDM), (iv) a modified bitumen ("modbit") roofing layer, or (v) a built-up roofing (BUR) layer.

In one embodiment, each tapered insulation panel of the plurality of tapered insulation panels comprises a tapered polyisocyanurate foam panel.

In one embodiment, the at least one non-tapered insulation panel comprises a non-tapered polyisocyanurate foam panel.

In one embodiment, the roofing system further comprises a plurality of fasteners installed through the membrane layer, the at least one non-tapered insulation panel, and the plurality of tapered insulation panels into the roof deck.

In one embodiment, the roofing system further comprises a substrate applied onto the roof deck. According to an embodiment, the substrate comprises at least one of a scrim, a fiberglass mat, or a polyester mat.

In one embodiment, the membrane layer has a thickness of 40 mils to 140 mils.

In one embodiment, one or more tapered insulation panels of the plurality of tapered insulation panels comprises (i) a different thickness, (ii) a different slope, or (iii) a combination of (i) and (ii).

In one embodiment, the at least one non-tapered insulation panel has a thickness of 0.5 inches to 4.5 inches.

In one embodiment, the roofing system comprises a low slope roof.

Another embodiment of this invention pertains to a roof assembly kit that includes a plurality of tapered insulation panels, wherein the plurality of tapered insulation panels is configured to be installed onto a roof deck of a low slope roof, at least one non-tapered insulation panel having an upper surface and a lower surface, wherein the lower surface of the at least one non-tapered insulation panel is configured to be installed onto the plurality of tapered insulation panels, a membrane layer having an upper surface and a lower surface, wherein the membrane layer is configured to be installed onto the upper surface of the at least one non-tapered insulation panel, and instructions for installation of (i) the plurality of tapered insulation panels on the roof deck, (ii) the at least one non-tapered insulation panel on the plurality of tapered insulation panels, and (iii) the membrane layer on the at least one non-tapered insulation panel, such that the upper surface of the membrane layer is exposed.

In one embodiment, the membrane layer comprises at least one of (i) a single-ply TPO membrane, (ii) a single-ply PVC membrane, (iii) an ethylene propylene diene terpolymer membrane (EPDM), (iv) a modified bitumen ("modbit") roofing layer, or (v) a built-up roofing (BUR) layer.

In one embodiment, each tapered insulation panel of the plurality of tapered insulation panels comprises a tapered polyisocyanurate foam panel.

In one embodiment, the at least one non-tapered insulation panel comprises a non-tapered polyisocyanurate foam panel.

In one embodiment, the roof assembly kit further comprises a plurality of fasteners configured to be installed through the membrane layer, the at least one non-tapered insulation panel, and the plurality of tapered insulation panels into the roof deck.

Another embodiment of this invention pertains to a method that includes obtaining a plurality of tapered insulation panels, the plurality of tapered insulation panels having an upper surface and a lower surface, obtaining at least one non-tapered insulation panel having an upper surface and a lower surface, obtaining a membrane layer having an upper surface and a lower surface, obtaining instructions for installation, applying the plurality of tapered insulation panels onto a roof deck in accordance with the instructions for installation, applying the at least one non-tapered insulation panel onto the plurality of tapered insulation panels, such that the lower surface of the at least one non-tapered insulation panel is applied onto the upper surface of the plurality of tapered insulation panels, in accordance with the instructions for installation, and applying the membrane layer to the upper surface of the at least one non-tapered insulation panel, such that the upper surface of the membrane layer is exposed and the lower surface of the membrane layer is applied onto the upper surface of the at least one non-tapered insulation panel, in accordance with the instructions for installation.

In one embodiment, the membrane layer comprises at least one of (i) a single-ply TPO membrane, (ii) a single-ply PVC membrane, (iii) an ethylene propylene diene terpolymer membrane (EPDM), (iv) a modified bitumen ("mod-bit") roofing layer, or (v) a built-up roofing (BUR) layer.

In one embodiment, each tapered insulation panel of the plurality of tapered insulation panels comprises a tapered polyisocyanurate foam panel.

In one embodiment, the at least one non-tapered insulation panel comprises a non-tapered polyisocyanurate foam panel.

In one embodiment, the method further comprises installing a plurality of fasteners through the membrane layer, the at least one non-tapered insulation panel, and the plurality of tapered insulation panels into the roof deck. In one embodiment, the installing of the plurality of fasteners is conducted by installing the plurality of fasteners in a certain pattern.

BRIEF DESCRIPTION OF THE FIGURES

For a more complete understanding of the invention and the advantages thereof, reference is made to the following descriptions, taken in conjunction with the accompanying figures, in which:

FIG. 5 is a table illustrating physical characteristics, including dimensions, and shipping information of tapered insulation panels according to embodiments of the invention.

FIG. 6A is a table illustrating physical characteristics, including insulation type, size, and thickness, of tapered insulation panels and the number of fasteners for mechanically attached systems according to embodiments of the invention.

FIG. 6B is a table illustrating physical characteristics, including insulation type, size, and thickness, of tapered insulation panels and the number of fasteners for adhered systems according to embodiments of the invention.

DETAILED DESCRIPTION OF THE INVENTION

Figure 1:
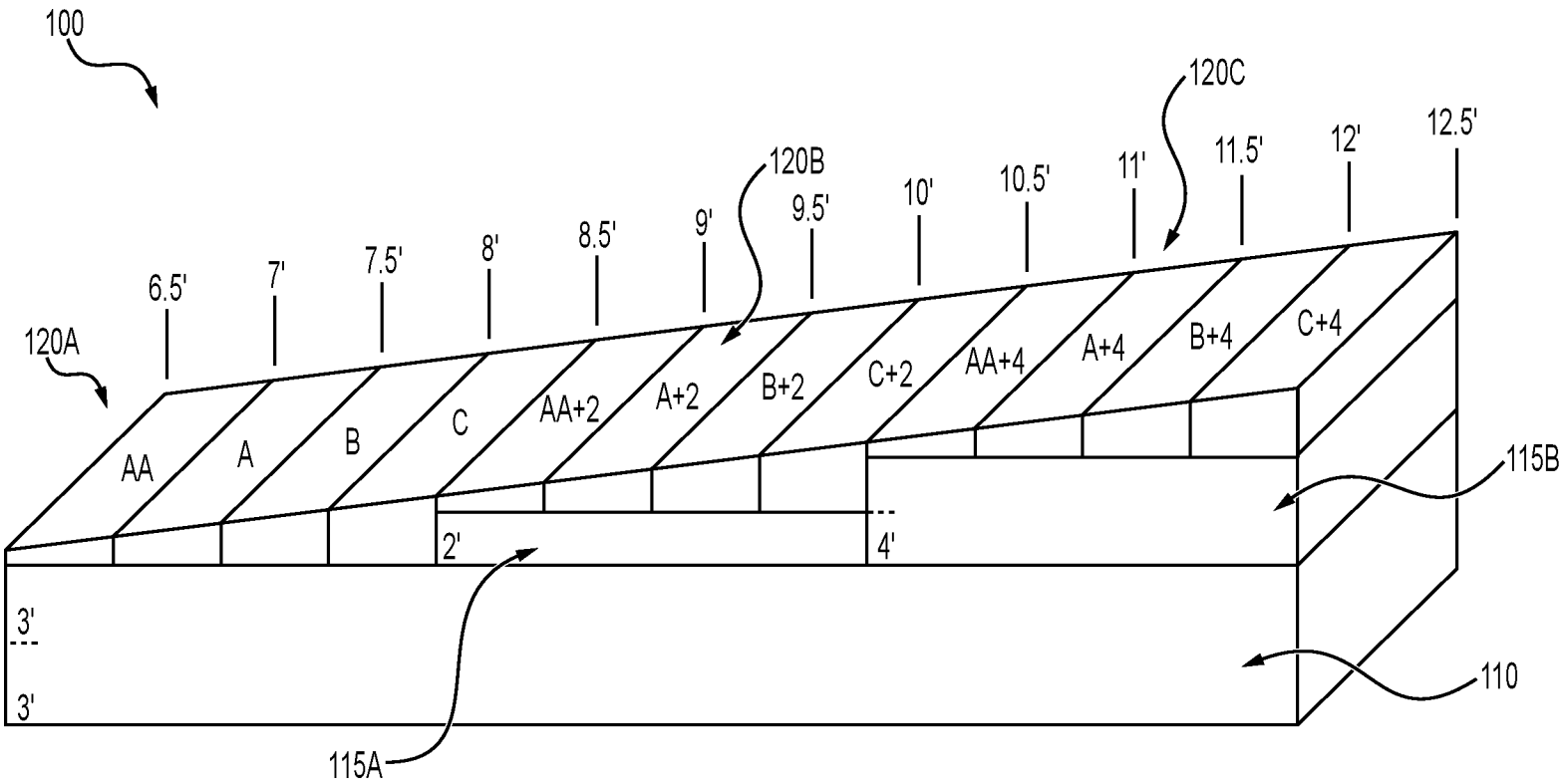
FIG. 1 (PRIOR ART)
FIG. 1 is an illustration of a prior art roofing system having tapered insulation panels.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "ISO" means polyisocyanurate.

As used herein, the term "TPO" means thermoplastic polyolefin.

As used herein, the term "PVC" means polyvinyl chloride.

As used herein, the term "EPDM" means ethylene propylene diene terpolymer membrane.

As used herein, the term "mod-bit" means a modified bitumen roofing layer or system.

As used herein, the term "BUR" means a built-up roofing layer or system.

As used in various embodiments herein, the tapered insulation is considered to have a run of 36' long and 4' wide, which equals to 144 square feet.

As used in various embodiments herein, to determine the approximate number of fasteners required for a roofing system having tapered insulation with a run of 36' long and 4' wide, the number of boards was multiplied by the run, and that number was divided by 144 to get the total square feet for the run, which provides the number of fasteners per square feet needed. This square foot number is multiplied by 10,000, in order to provide the total fastener count for 100 squares.

As used in various embodiments herein, to determine the approximate amount of adhesive required for a roofing system having tapered insulation with a run of 36' long and 4' wide, the number of boards was multiplied by the run, which equals to 384 square feet for the 36' run. This number (384) is then divided by 144 to get the amount of adhesive per square foot. This number is then multiplied by 10,000, in order to provide the total square feet of adhesive required for 100 squares.

As used in various embodiments herein, in order to determine the approximate panel count, the total number of panels is divided by 144 and this number is multiplied by 10,000, in order to provide the total number of panels for 100 squares.

In accordance with the prior art, as discussed above, roof installers install tapered insulation panels (e.g., polyisocyanurate (ISO) foam panels) or boards sandwiched between a top layer of a single-ply membrane (e.g., a TPO or PVC membrane) and a bottom layer of a non-tapered insulation panel(s) or board(s), to meet the insulation and overall performance requirements of roof systems. This current method requires a significant amount of additional fasteners and labor to install.

For example, FIG. 1 illustrates a prior art method or practice of installing a roofing system having tapered insulation. In particular, FIG. 1 illustrates a roofing system that is a four panel system for a ⅛" slope roof having tapered insulation (e.g., tapered ISO foam panels (4'×4' panels)). As shown in FIG. 1, a roofing system 100 is provided that includes a plurality of tapered insulation panels 120A, 120B, and 120C that is sandwiched between (i) a membrane (not shown) on top and (ii) a non-tapered insulation panel (e.g., an ISO foam board) 110 on the bottom. As further shown in FIG. 1, a first set or plurality of tapered insulation panels 120A is placed on top of the non-tapered insulation panel 110 (e.g., a 3" flat ISO foam board or panel), while a second set or plurality of tapered insulation panels 120B is placed on top of a first fill material 115A (e.g., a 2" flat ISO foam board or panel), which is placed on top of the non-tapered insulation panel 110, and a third set or plurality of tapered insulation panels 120C is placed on top of a second fill material 115B (e.g., a 4" flat ISO foam board or panel), which is placed on top of the non-tapered insulation panel 110. The system and method of FIG. 1 requires a significant amount of fasteners of different lengths (e.g., depending on the taper depth) to be used to secure the membrane through the non-tapered insulation panel or board to the roof deck.

Thus, the purpose of the present invention is to offer a roofing system and an installation method that involves tapered and non-tapered insulation panels that improves case of installation, reduces materials (e.g., required fasteners), and reduces labor costs, without compromising the system performance (e.g., fully adhered systems). In this regard, a new commercial roofing system and installation procedure is provided for tapered insulation (e.g., tapered ISO foam boards) that improves case of installation, reduces materials, and reduces labor cost without compromising the warranty of the system.

One embodiment of this invention pertains to a roofing system that includes a roof deck, a plurality of tapered insulation panels applied onto the roof deck, with the plurality of tapered insulation panels having an upper surface and a lower surface, at least one non-tapered insulation panel applied onto the upper surface of the plurality of tapered insulation panels, with the at least one non-tapered insulation panel having an upper surface and a lower surface, with the lower surface of the at least one non-tapered insulation panel being applied onto the upper surface of the plurality of tapered insulation panels, and a membrane layer applied onto the upper surface of the at least one non-tapered insulation panel. The membrane layer has an upper surface and a lower surface, such that the lower surface of the membrane layer is applied onto the upper surface of the at least one non-tapered insulation panel. The roofing system is applied in accordance with instructions for installation, such that (i) the plurality of tapered insulation panels are applied onto the roof deck, (ii) the at least one non-tapered insulation panel is applied onto the upper surface of the plurality of tapered insulation panels, and (iii) the membrane layer is applied onto the upper surface of the at least one non-tapered insulation panel, such that the upper surface of the membrane layer is exposed.

Figure 2:
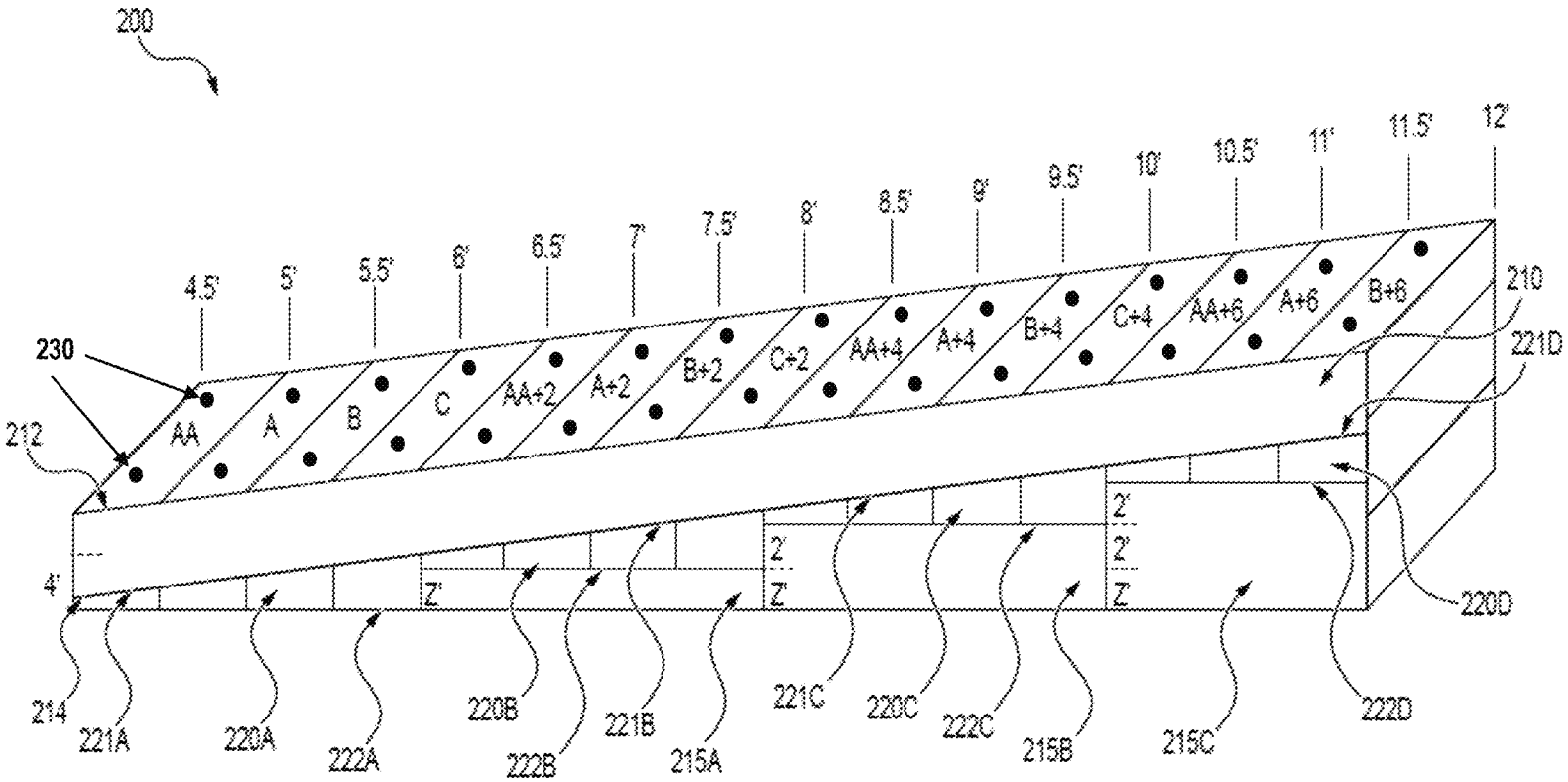
FIG. 2 is an illustration of a roofing system having tapered insulation panels according to an embodiment of the invention.

FIG. 2 illustrates a roofing system according to an embodiment of the invention. In this embodiment, as shown in FIG. 2, the roofing system 200 includes a non-tapered insulation panel (e.g., a non-tapered ISO foam board) 210 that is sandwiched between a top membrane layer (not shown) and a plurality of tapered insulation panels (e.g., tapered ISO foam boards) 220A, 220B, 220C, and 220D on the bottom. The non-tapered insulation panel 210 has an upper surface 212 and a lower surface 214, with the lower surface 214 being applied onto an upper surface (described below) of the plurality of tapered insulation panels 220A, 220B, 220C, and 220D, and the upper surface 212 having a membrane layer (not shown) applied thereto. As further shown in the embodiment of FIG. 2, a first set or plurality of tapered insulation panels 220A has an upper surface 221A and a lower surface 222A, with the lower surface 222A of the plurality of tapered insulation panels 220A being provided on a roof deck (not shown) and the upper surface 221A of the plurality of tapered insulation panels 220A being in contact with the lower surface 214 of the non-tapered insulation panel 210. As also shown in the embodiment of FIG. 2, a second set or plurality of tapered insulation panels 220B has an upper surface 221B and a lower surface 222B, with the lower surface 222B of the plurality of tapered insulation panels 220B being provided on top of a first fill material 215A (e.g., a 2" flat ISO foam board or panel) and the upper surface 221B of the plurality of tapered insulation panels 220B being in contact with the lower surface 214 of the non-tapered insulation panel 210. As shown in the embodiment of FIG. 2, a third set or plurality of tapered insulation panels 220C has an upper surface 221C and a lower surface 222C, with the lower surface 222C of the plurality of tapered insulation panels 220C being provided on top of a second fill material 215B (e.g., two, 2" flat ISO foam boards or panels) and the upper surface 221C of the plurality of tapered insulation panels 220C being in contact with the lower surface 214 of the non-tapered insulation panel 210. As further shown in the embodiment of FIG. 2, a fourth set or plurality of tapered insulation panels 220D has an upper surface 221D and a lower surface 222D, with the lower surface 222D of the plurality of tapered insulation panels 220D being provided on top of a third fill material 215C (e.g., three, 2" flat ISO foam boards or panels) and the upper surface 221D of the plurality of tapered insulation panels 220D being in contact with the lower surface 214 of the non-tapered insulation panel 210. As also shown in the embodiment of FIG. 2, a plurality of fasteners 230 are included and installed through the membrane layer (not shown), the non-tapered insulation panel 210, and the plurality of tapered insulation panels 220A, 220B, 220C, 220D into a roof deck (not shown)

In one embodiment, the membrane layer comprises at least one of (i) a single-ply TPO membrane, (ii) a single-ply PVC membrane, (iii) an ethylene propylene diene terpolymer membrane (EPDM), (iv) a modified bitumen ("modbit") roofing layer, or (v) a built-up roofing (BUR) layer.

In one embodiment, each tapered insulation panel of the plurality of tapered insulation panels comprises a tapered polyisocyanurate foam panel.

In one embodiment, the at least one non-tapered insulation panel comprises a non-tapered polyisocyanurate foam panel.

In one embodiment, the roofing system further comprises a plurality of fasteners installed through the membrane layer, the at least one non-tapered insulation panel, and the plurality of tapered insulation panels into the roof deck.

In one embodiment, the roofing system further comprises a substrate applied onto the roof deck. According to an embodiment, the substrate comprises at least one of a scrim, a fiberglass mat, or a polyester mat.

In one embodiment, the membrane layer has a thickness of 40 mils to 140 mils. In one embodiment, the membrane layer has a thickness of 40 mils to 120 mils. In one embodiment, the membrane layer has a thickness of 40 mils to 100 mils. In one embodiment, the membrane layer has a thickness of 40 mils to 80 mils. In one embodiment, the membrane layer has a thickness of 40 mils to 60 mils. In one embodiment, the membrane layer has a thickness of 60 mils to 140 mils. In one embodiment, the membrane layer has a thickness of 60 mils to 120 mils. In one embodiment, the membrane layer has a thickness of 60 mils to 100 mils. In one embodiment, the membrane layer has a thickness of 60 mils to 80 mils. In one embodiment, the membrane layer has a thickness of 80 mils to 140 mils. In one embodiment, the membrane layer has a thickness of 80 mils to 120 mils. In one embodiment, the membrane layer has a thickness of 80 mils to 100 mils. In one embodiment, the membrane layer has a thickness of 100 mils to 140 mils. In one embodiment, the membrane layer has a thickness of 100 mils to 120 mils. In one embodiment, the membrane layer has a thickness of 120 mils to 140 mils.

In one embodiment, one or more tapered insulation panels of the plurality of tapered insulation panels comprises (i) a different thickness, (ii) a different slope, or (iii) a combination of (i) and (ii). For example, as shown in, e.g., the Table of FIG. 5, the physical characteristics, e.g., slope, thickness, size, etc., of various tapered insulation panels (e.g., AA, A, B, C, D, etc.), which represent some of the tapered insulation panels illustrated in the embodiment of FIG. 2, are illustrated, along with their shipping information, according to some embodiments of the invention.

In one embodiment, the at least one non-tapered insulation panel has a thickness of 0.5 inches to 4.5 inches. In one embodiment, the at least one non-tapered insulation panel has a thickness of 0.5 inches to 4 inches. In one embodiment, the at least one non-tapered insulation panel has a thickness of 0.5 inches to 3.5 inches. In one embodiment, the at least one non-tapered insulation panel has a thickness of 0.5 inches to 3 inches. In one embodiment, the at least one non-tapered insulation panel has a thickness of 0.5 inches to 2.5 inches. In one embodiment, the at least one non-tapered insulation panel has a thickness of 0.5 inches to 2 inches. In one embodiment, the at least one non-tapered insulation panel has a thickness of 0.5 inches to 1.5 inches. In one embodiment, the at least one non-tapered insulation panel has a thickness of 0.5 inches to 1 inch. In one embodiment, the at least one non-tapered insulation panel has a thickness of 1 inch to 4.5 inches. In one embodiment, the at least one non-tapered insulation panel has a thickness of 1 inch to 4 inches. In one embodiment, the at least one non-tapered insulation panel has a thickness of 1 inch to 3.5 inches. In one embodiment, the at least one non-tapered insulation panel has a thickness of 1 inch to 3 inches. In one embodiment, the at least one non-tapered insulation panel has a thickness of 1 inch to 2.5 inches. In one embodiment, the at least one non-tapered insulation panel has a thickness of 1 inch to 2 inches. In one embodiment, the at least one non-tapered insulation panel has a thickness of 1 inch to 1.5 inches. In one embodiment, the at least one non-tapered insulation panel has a thickness of 1.5 inches to 4.5 inches. In one embodiment, the at least one non-tapered insulation panel has a thickness of 1.5 inches to 4 inches. In one embodiment, the at least one non-tapered insulation panel has a thickness of 1.5 inches to 3.5 inches. In one embodiment, the at least one non-tapered insulation panel has a thickness of 1.5 inches to 3 inches. In one embodiment, the at least one non-tapered insulation panel has a thickness of 1.5 inches to 2.5 inches. In one embodiment, the at least one non-tapered insulation panel has a thickness of 1.5 inches to 2 inches. In one embodiment, the at least one non-tapered insulation panel has a thickness of 2 inches to 4.5 inches. In one embodiment, the at least one non-tapered insulation panel has a thickness of 2 inches to 4 inches. In one embodiment, the at least one non-tapered insulation panel has a thickness of 2 inches to 3.5 inches. In one embodiment, the at least one non-tapered insulation panel has a thickness of 2 inches to 3 inches. In one embodiment, the at least one non-tapered insulation panel has a thickness of 2 inches to 2.5 inches. In one embodiment, the at least one non-tapered insulation panel has a thickness of 2.5 inches to 4.5 inches. In one embodiment, the at least one non-tapered insulation panel has a thickness of 2.5 inches to 4 inches. In one embodiment, the at least one non-tapered insulation panel has a thickness of 2.5 inches to 3.5 inches. In one embodiment, the at least one non-tapered insulation panel has a thickness of 2.5 inches to 3 inches. In one embodiment, the at least one non-tapered insulation panel has a thickness of 3 inches to 4.5 inches. In one embodiment, the at least one non-tapered insulation panel has a thickness of 3 inches to 4 inches. In one embodiment, the at least one non-tapered insulation panel has a thickness of 3 inches to 3.5 inches. In one embodiment, the at least one non-tapered insulation panel has a thickness of 3.5 inches to 4.5 inches. In one embodiment, the at least one non-tapered insulation panel has a thickness of 3.5 inches to 4 inches. In one embodiment, the at least one non-tapered insulation panel has a thickness of 4 inches to 4.5 inches.

In one embodiment, the roofing system comprises a low slope roof.

According to an embodiment, the plurality of tapered insulation panels 220A, 220B, 220C, and 220D of the roofing system 200 of FIG. 2 requires a significantly reduced amount of fasteners per related codes to secure the membrane layer (not shown) through the non-tapered insulation panel 210 and the plurality of tapered insulation panels 220A, 220B, 220C, and 220D to the roof deck (not shown), which will result in a reduced number of fasteners overall. Moreover, per relevant codes, the wind resistance of the roofing system of the invention will not be negatively impacted by this new method of installation that uses less fasteners and/or a certain fastening pattern(s). In addition, by using less fasteners and/or a certain fastening pattern(s), the occurrence of thermal bridging is decreased. (See, e.g., the Tables of FIGS. 6A and 6B, which illustrate the number of fasteners for mechanically attached systems and adhered systems, respectively, having tapered insulation depending on, e.g., the insulation type (e.g., polyiso, perlite, extruded polystyrene, expanded polystyrene, gypsum board, wood fiber, etc.), board or panel size, and thickness, according to some embodiments of the invention.)

Figure 3A:
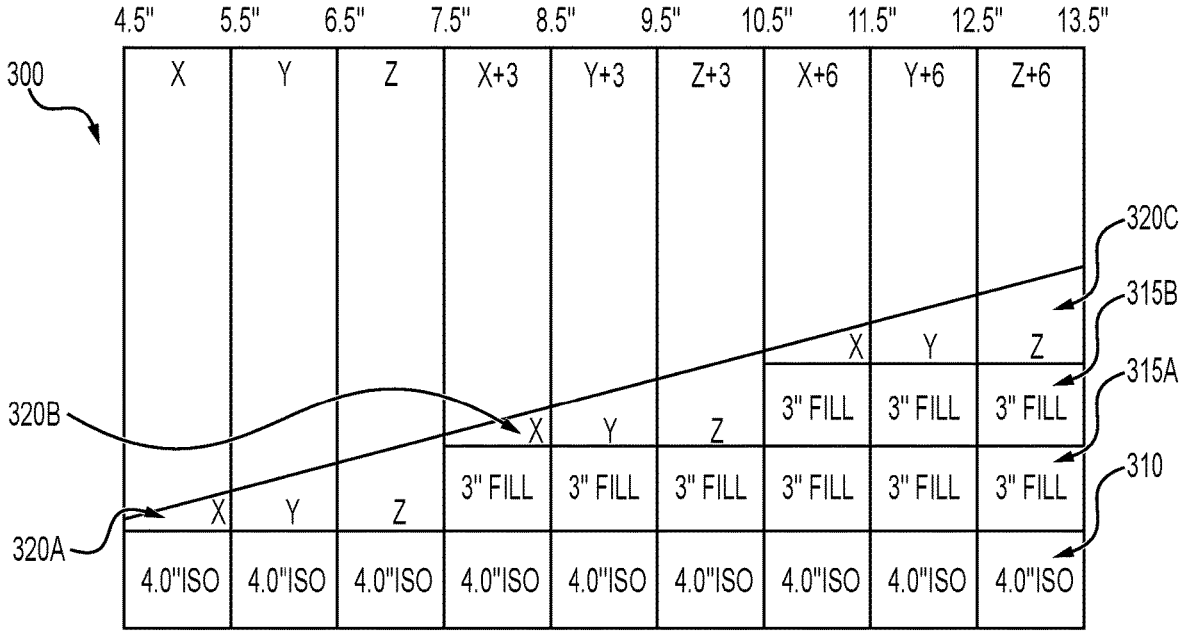
FIG. 3A (PRIOR ART)
FIGS. 3A and 3B are illustrations of prior art roofing systems having tapered insulation panels.
Figure 3B:
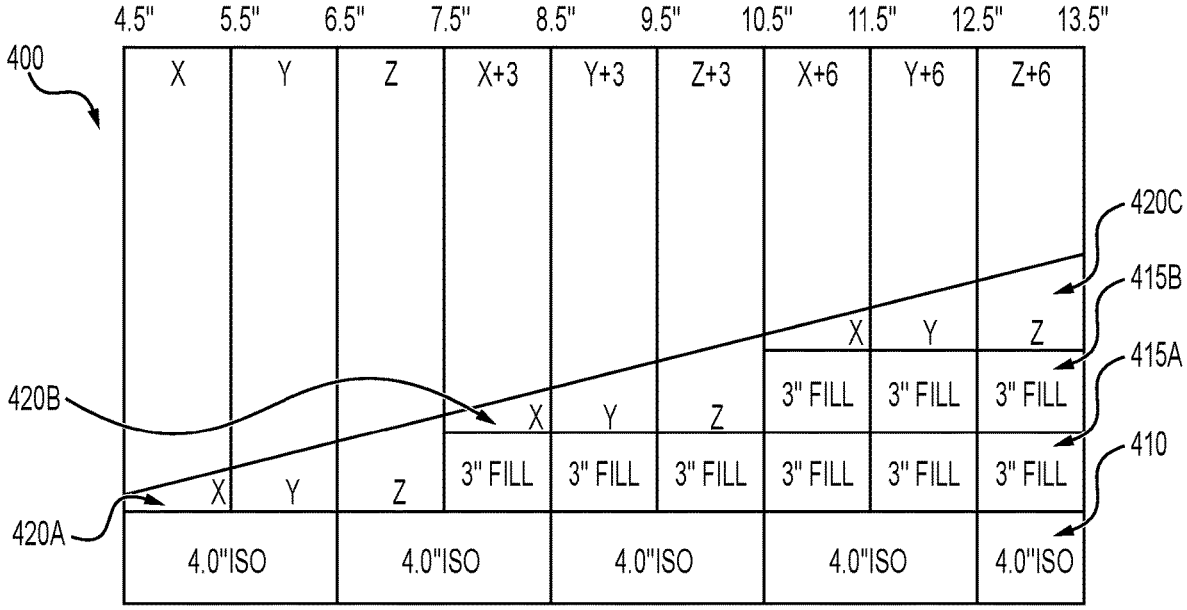
FIG. 3B (PRIOR ART)
Figure 3C:
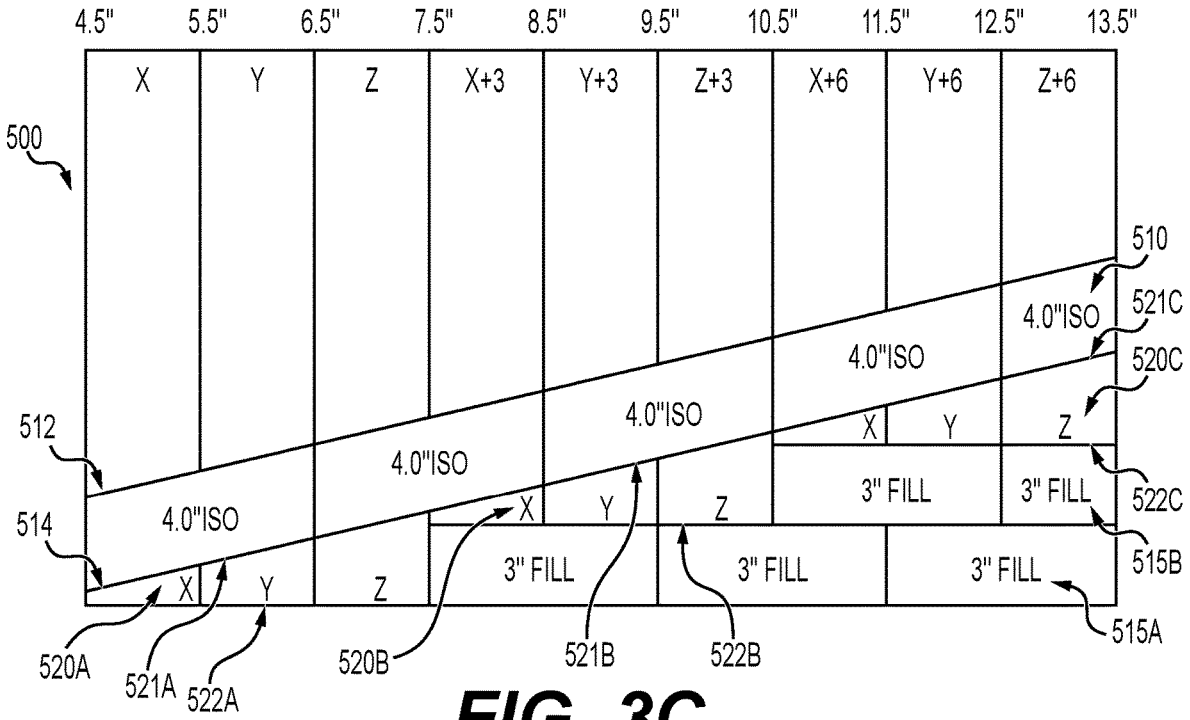
FIGS. 3C and 3D are illustrations of roofing systems having tapered insulation panels according to embodiments of the invention.
Figure 3D:
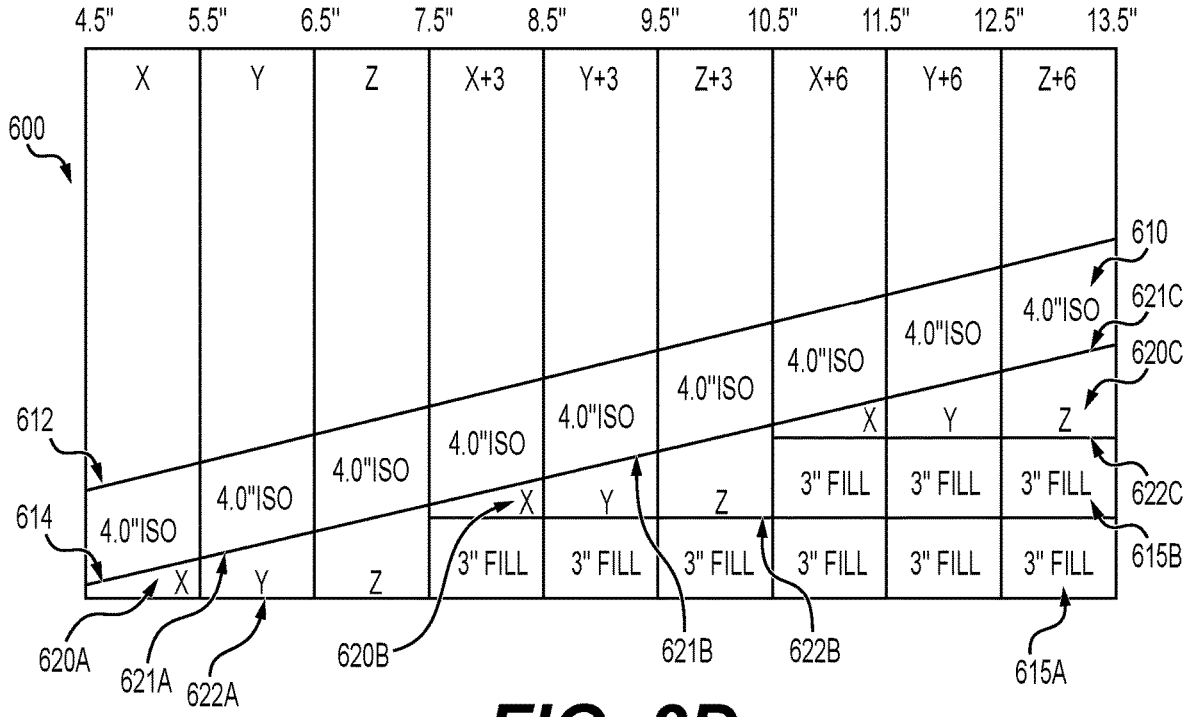

FIGS. 3A and 3B illustrate a prior art method or practice of installing a roofing system having tapered insulation in comparison to FIGS. 3C and 3D, which illustrate roofing systems according to embodiments of the invention. In this regard, FIG. 3A illustrates a roofing system that is a four-by-four panel or base layer system with a four-by-four fill layer for a ¼" slope roof having tapered insulation (e.g., tapered ISO foam panels (4'×4' panels)). As shown in FIG. 3A, a roofing system 300 is provided that includes a plurality of tapered insulation panels 320A, 320B, and 320C that is sandwiched between (i) a membrane (not shown) on top and (ii) a plurality of non-tapered insulation panels (e.g., 4" ISO foam boards) 310 on the bottom. As further shown in FIG. 3A, a first set or plurality of tapered insulation panels 320A is placed on top of the plurality of non-tapered insulation panels 310 (e.g., three, 4" flat ISO foam boards or panels), while a second set or plurality of tapered insulation panels 320B is placed on top of a first fill material 315A (e.g., three, 3" fill materials or three, 3" flat ISO foam boards or panels), which is placed on top of the plurality of non-tapered insulation panels 310 (e.g., three, 4" flat ISO foam boards or panels), and a third set or plurality of tapered insulation panels 320C is placed on top of a second fill material 315B (e.g., three, 3" fill materials or three, 3" flat ISO foam boards or panels), which is placed on top of (i) the first fill material 315A (e.g., three, 3" fill materials or three, 3" flat ISO foam boards or panels) and (ii) the plurality of non-tapered insulation panels 310 (e.g., three, 4" flat ISO foam boards or panels). The system and method of FIG. 3A requires at least 1875 panels to be purchased and installed. The system and method of FIG. 3A further requires a significant amount of fasteners to be used to secure the membrane through the non-tapered insulation panel or board to the roof deck (e.g., 2500 fasteners for the top layer (i.e., 9 boards×4=36 divided by 144×10,000 equals 2500) or 2917 fasteners for the base layer), as well as at least 20,000 square feet of adhesive (i.e., 3 layers of adhesive: 18 panels of adhesive×4 (run width) equals 72 square feet of adhesive divided by 144, which equals 0.5×10,000 equals 20,000 square feet of adhesive).

FIG. 3B illustrates a roofing system that is a four-by-eight panel or base layer system with a four-by-four fill layer for a ¼" slope roof having tapered insulation (e.g., tapered ISO foam panels (4'×8' panels)). As shown in FIG. 3B, a roofing system 400 is provided that includes a plurality of tapered insulation panels 420A, 420B, and 420C that is sandwiched between (i) a membrane (not shown) on top and (ii) a plurality of non-tapered insulation panels (e.g., 4" ISO foam boards) 410 on the bottom. As further shown in FIG. 3B, a first set or plurality of tapered insulation panels 420A is placed on top of the plurality of non-tapered insulation panels 410 (e.g., one or more, 4" flat ISO foam boards or panels), while a second set or plurality of tapered insulation panels 420B is placed on top of a first fill material 415A (e.g., three, 3" fill materials or three, 3" flat ISO foam boards or panels), which is placed on top of the plurality of non-tapered insulation panels 410 (e.g., one or more, 4" flat ISO foam boards or panels), and a third set or plurality of tapered insulation panels 420C is placed on top of a second fill material 415B (e.g., three, 3" fill materials or three, 3" flat ISO foam boards or panels), which is placed on top of (i) the first fill material 415A (e.g., three, 3" fill materials or three, 3" flat ISO foam boards or panels) and (ii) the plurality of non-tapered insulation panels 410 (e.g., one or more, 4" flat ISO foam boards or panels). The system and method of FIG. 3B requires at least 1597 panels to be purchased and installed. The system and method of FIG. 3B further requires a significant amount of fasteners to be used to secure the membrane through the non-tapered insulation panel or board to the roof deck (e.g., 2500 fasteners for the top layer (i.e., 9 boards×4=36 divided by 144×10,000 equals 2500) or 2917 fasteners for the base layer), as well as at least 20,000 square feet of adhesive.

By contrast, FIGS. 3C and 3D illustrate roofing systems according to embodiments of the invention (e.g., inverted tapered roofing systems). In the embodiment of FIG. 3C, an inverted tapered roofing system 500 is provided that is a four-by-eight panel or base layer system on top (i.e., inverted) with a four-by-eight fill layer for a ¼" slope roof having tapered insulation. As shown in FIG. 3C, the roofing system 500 includes a plurality of non-tapered insulation panels (e.g., 4" non-tapered ISO foam boards) 510 that is sandwiched between a top membrane layer (not shown) and a plurality of tapered insulation panels (e.g., tapered ISO foam boards) 520A, 520B, and 520C on the bottom. The plurality of non-tapered insulation panels 510 has an upper surface 512 and a lower surface 514, with the lower surface 514 being applied onto an upper surface (described below) of the plurality of tapered insulation panels 520A, 520B, and 520C, and the upper surface 512 having a membrane layer (not shown) applied thereto. As further shown in the embodiment of FIG. 3C, a first set or plurality of tapered insulation panels 520A has an upper surface 521A and a lower surface 522A, with the lower surface 522A of the plurality of tapered insulation panels 520A being provided on a roof deck (not shown) and the upper surface 521A of the plurality of tapered insulation panels 520A being in contact with the lower surface 514 of the plurality of non-tapered insulation panels 510. As also shown in the embodiment of FIG. 3C, a second set or plurality of tapered insulation panels 520B has an upper surface 521B and a lower surface 522B, with the lower surface 522B of the plurality of tapered insulation panels 520B being provided on top of a first fill material 515A (e.g., one or more 3" fill materials or one or more 3" flat ISO foam boards or panels) and the upper surface 521B of the plurality of tapered insulation panels 520B being in contact with the lower surface 514 of the plurality of non-tapered insulation panels 510. As further shown in the embodiment of FIG. 3C, a third set or plurality of tapered insulation panels 520C has an upper surface 521C and a lower surface 522C, with the lower surface 522C of the plurality of tapered insulation panels 520C being provided on top of (i) a second fill material 515B (e.g., two, 3" fill materials or two, 3" flat ISO foam boards or panels) and (ii) the first fill material 515A (e.g., one or more 3" fill materials or one or more 3" flat ISO foam boards or panels), and the upper surface 521C of the plurality of tapered insulation panels 520C being in contact with the lower surface 514 of the plurality of non-tapered insulation panels 510. The system and method of FIG. 3C requires at least 1319 panels to be purchased and installed, which is at least thirty percent less than the prior art system and method shown in FIG. 3A and/or FIG. 3B. The system and method of FIG. 3C further requires a lesser amount of fasteners to be used to secure (e.g., mechanically attach) the membrane (e.g., ISO top layer) to the roof deck (e.g., 1563 fasteners for the top layer) or 3241 fasteners to mechanically fasten the base layer, and at least 20,000 square feet of adhesive.

FIG. 3D illustrates a roofing system according to another embodiment of the invention (e.g., an inverted tapered roofing system). In the embodiment of FIG. 3D, an inverted tapered roofing system 600 is provided that is a four-by-four panel or base layer system on top (i.e., inverted) with a four-by-four fill layer for a ¼" slope roof having tapered insulation. As shown in FIG. 3D, the roofing system 600 includes a plurality of non-tapered insulation panels (e.g., 4" non-tapered ISO foam boards) 610 that is sandwiched between a top membrane layer (not shown) and a plurality of tapered insulation panels (e.g., tapered ISO foam boards) 620A, 620B, and 620C on the bottom. The plurality of non-tapered insulation panels 610 has an upper surface 612 and a lower surface 614, with the lower surface 614 being applied onto an upper surface (described below) of the plurality of tapered insulation panels 620A, 620B, and 620C, and the upper surface 612 having a membrane layer (not shown) applied thereto. As further shown in the embodiment of FIG. 3D, a first set or plurality of tapered insulation panels 620A has an upper surface 621A and a lower surface 622A, with the lower surface 622A of the plurality of tapered insulation panels 620A being provided on a roof deck (not shown) and the upper surface 621A of the plurality of tapered insulation panels 620A being in contact with the lower surface 614 of the plurality of non-tapered insulation panels 610. As also shown in the embodiment of FIG. 3D, a second set or plurality of tapered insulation panels 620B has an upper surface 621B and a lower surface 622B, with the lower surface 622B of the plurality of tapered insulation panels 620B being provided on top of a first fill material 615A (e.g., three, 3" fill materials or three, 3" flat ISO foam boards or panels) and the upper surface 621B of the plurality of tapered insulation panels 620B being in contact with the lower surface 614 of the plurality of non-tapered insulation panels 610. As further shown in the embodiment of FIG. 3D, a third set or plurality of tapered insulation panels 620C has an upper surface 621C and a lower surface 622C, with the lower surface 622C of the plurality of tapered insulation panels 620C being provided on top of (i) a second fill material 615B (e.g., three, 3" fill materials or three, 3" flat ISO foam boards or panels) and (ii) the first fill material 615A (e.g., three, 3" fill materials or three, 3" flat ISO foam boards or panels), and the upper surface 621C of the plurality of tapered insulation panels 620C being in contact with the lower surface 614 of the plurality of non-tapered insulation panels 610. The system and method of FIG. 3D requires at least 1875 panels to be purchased and installed. The system and method of FIG. 3D further requires an equal amount of fasteners, as compared to the prior art system and method shown in FIG. 3A and/or FIG. 3B, to secure (e.g., mechanically attach) the membrane (e.g., ISO top layer) to the roof deck (e.g., 2500 fasteners for the top layer (i.e., 9 boards×4 equals 36 divided by 144× 10,000 equals 2500)) or 3241 fasteners to mechanically fasten the base layer, and at least 20,000 square feet of adhesive.

Figure 4A:
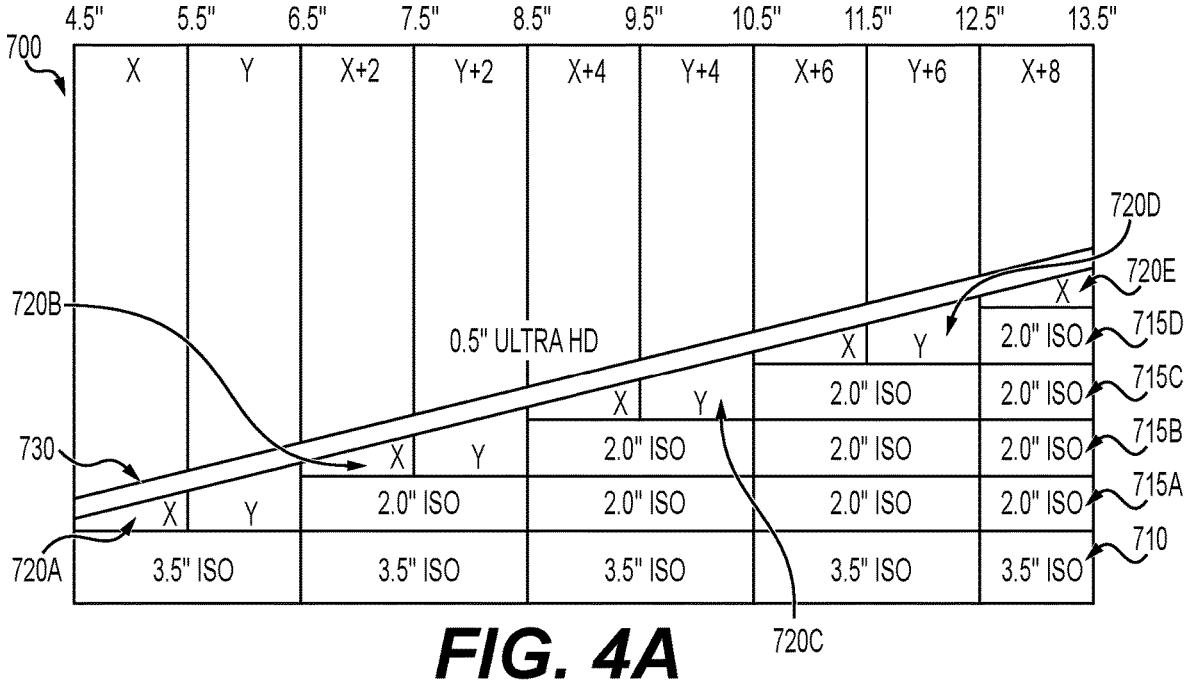
FIG. 4A (PRIOR ART)
FIGS. 4A and 4B are illustrations of prior art roofing systems having tapered insulation panels.
Figure 4B:
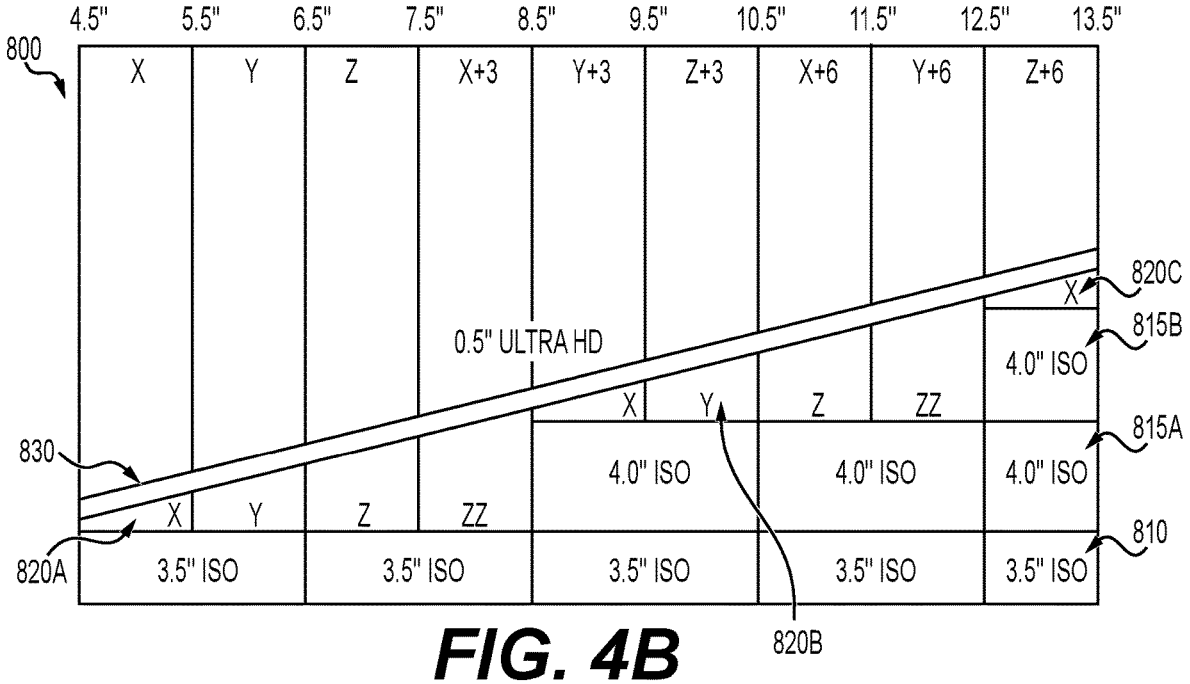
FIG. 4B (PRIOR ART)
Figure 4C:
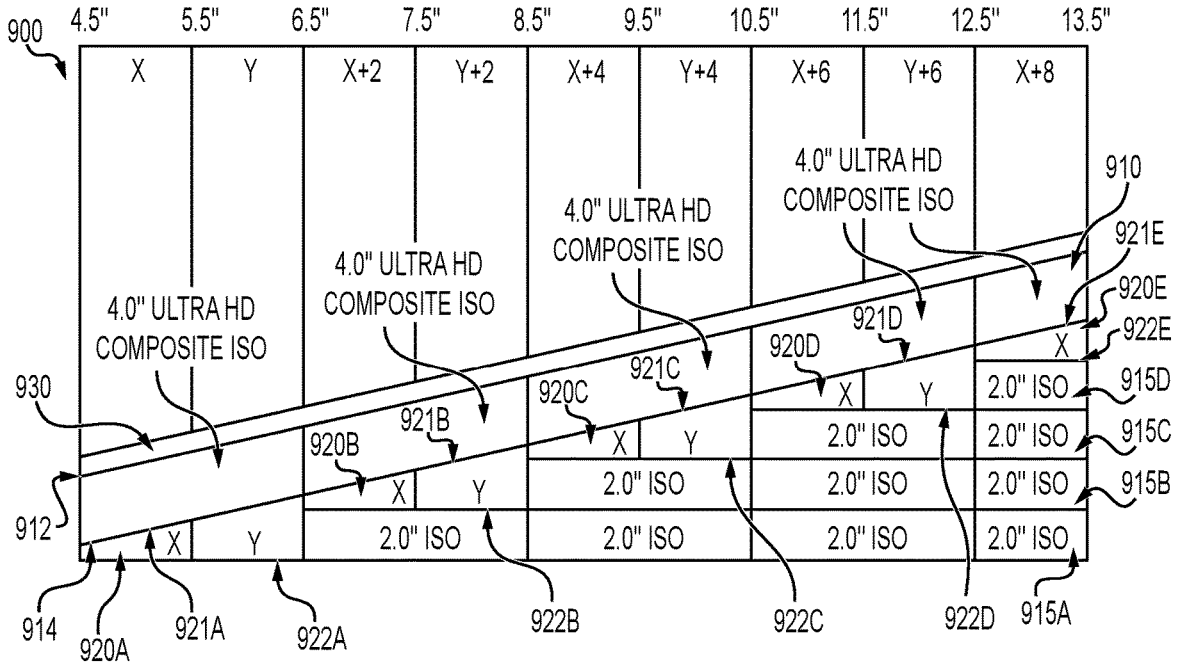
FIGS. 4C and 4D are illustrations of roofing systems having tapered insulation panels according to embodiments of the invention.
Figure 4D:
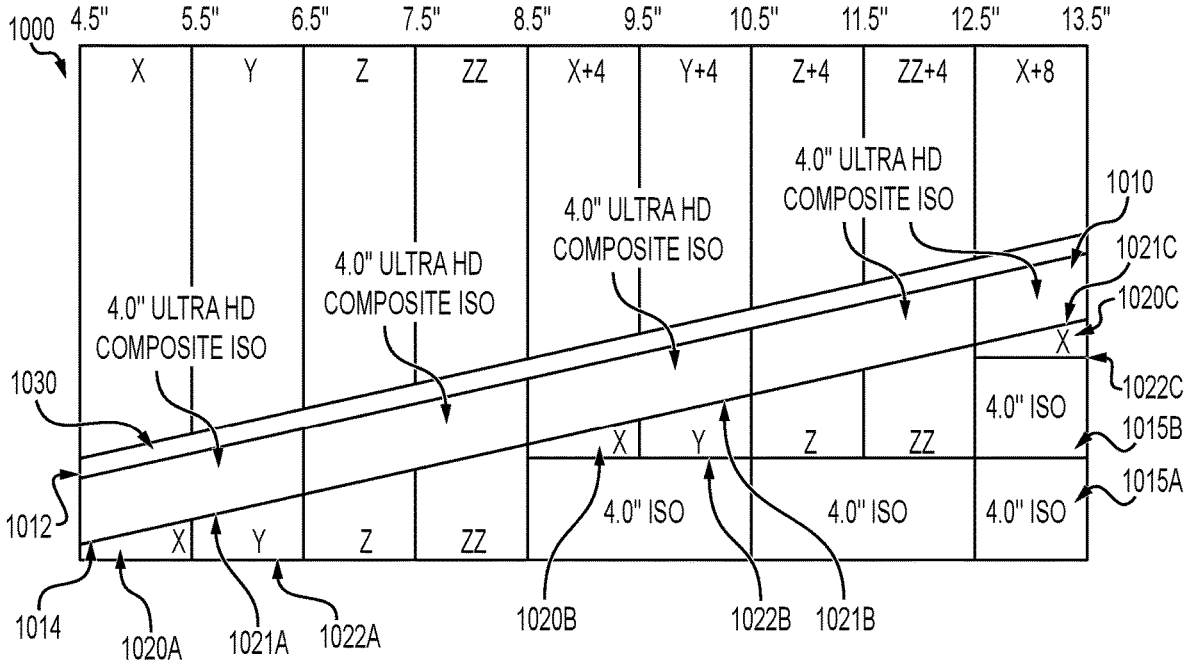

FIGS. 4A and 4B illustrate a prior art method or practice of installing a roofing system having tapered insulation in comparison to FIGS. 4C and 4D, which illustrate roofing systems according to embodiments of the invention. In this regard, FIG. 4A illustrates a roofing system that is a four-by-eight panel or base layer system with a four-by-eight fill layer for a ¼" slope roof having tapered insulation (e.g., a standard panel repeat plus a 4×8 cover board)). As shown in FIG. 4A, a roofing system 700 is provided that includes a plurality of tapered insulation panels 720A, 720B, 720C, 720D, and 720E that is sandwiched between (i) a membrane or cover board layer (e.g., a 0.5" cover board) 730 on top and (ii) a plurality of non-tapered insulation panels (e.g., 3.5" ISO foam boards) 710 on the bottom. As further shown in FIG. 4A, a first set or plurality of tapered insulation panels 720A is placed on top of at least one of the non-tapered insulation panels 710 (e.g., one, 3.5" flat ISO foam board or panel), while a second set or plurality of tapered insulation panels 720B is placed on top of a first fill material 715A (e.g., one, 2" fill material or one, 2" flat ISO foam board or panel), which is placed on top of at least one of the non-tapered insulation panels 710 (e.g., one, 3.5" flat ISO foam board or panel). A third set or plurality of tapered insulation panels 720C is provided that is placed on top of a second fill material 715B (e.g., one, 2" fill material or one, 2" flat ISO foam board or panel), which is placed on top of (i) the first fill material 715A (e.g., one, 2" fill material or one, 2" flat ISO foam board or panel) and (ii) at least one of the plurality of non-tapered insulation panels 710 (e.g., one, 3.5" flat ISO foam board or panel). A fourth set or plurality of tapered insulation panels 720D is provided that is placed on top of a third fill material 715C (e.g., one, 2" fill material or one, 2" flat ISO foam board or panel), which is placed on top of (i) the second fill material 715B (e.g., one, 2" fill material or one, 2" flat ISO foam board or panel), (ii) the first fill material 715A (e.g., one, 2" fill material or one, 2" flat ISO foam board or panel), and (iii) at least one of the plurality of non-tapered insulation panels 710 (e.g., one, 3.5" flat ISO foam board or panel). Lastly, a fifth set or one or more tapered insulation panels 720E is provided that is placed on top of a fourth fill material 715D (e.g., one, 2" fill material or one, 2" flat ISO foam board or panel), which is placed on top of (i) the third fill material 715C (e.g., one, 2" fill material or one, 2" flat ISO foam board or panel) (ii) the second fill material 715B (e.g., one, 2" fill material or one, 2" flat ISO foam board or panel), (iii) the first fill material 715A (e.g., one, 2" fill material or one, 2" flat ISO foam board or panel), and (iv) at least one of the plurality of non-tapered insulation panels 710 (e.g., one, 3.5" flat ISO foam board or panel). The system and method of FIG. 4A requires at least 2013 panels and a cover board to be purchased and installed. The system and method of FIG. 4A further requires a significant amount of fasteners to be used to secure the cover board through the non-tapered insulation panel or board to the roof deck (e.g., 1563 fasteners for the cover board or 2917 fasteners for the base layer), as well as at least 37,778 square feet of adhesive.

FIG. 4B illustrates a roofing system that is a four-by-eight panel or base layer system with a four-by-eight fill layer for a ¼" slope roof having tapered insulation (e.g., an extended panel repeat with a cover board). As shown in FIG. 4B, a roofing system 800 is provided that includes a plurality of tapered insulation panels 820A, 820B, and 820C that is sandwiched between (i) a membrane or cover board layer (e.g., a 0.5" cover board) 830 on top and (ii) a plurality of non-tapered insulation panels (e.g., 3.5" ISO foam boards) 810 on the bottom. As further shown in FIG. 4B, a first set or plurality of tapered insulation panels 820A is placed on top of the plurality of non-tapered insulation panels 810 (e.g., two, 3.5" flat ISO foam boards or panels), while a second set or plurality of tapered insulation panels 820B is placed on top of a first fill material 815A (e.g., two, 4" fill materials or two, 4" flat ISO foam boards or panels), which is placed on top of the plurality of non-tapered insulation panels 810 (e.g., two, 3.5" flat ISO foam boards or panels), and a third set or one or more tapered insulation panels 820C is placed on top of a second fill material 815B (e.g., one, 4" fill material or one, 4" flat ISO foam board or panel), which is placed on top of (i) the first fill material 815A (e.g., one, 4" fill material or one, 4" flat ISO foam board or panel) and (ii) at least one of the plurality of non-tapered insulation panels 810 (e.g., one, 3.5" flat ISO foam board or panel). The system and method of FIG. 4B requires at least 1597 panels to be purchased and installed. The system and method of FIG. 4B further requires a significant amount of fasteners to be used to secure the cover board through the non-tapered insulation panel or board to the roof deck (e.g., 1563 fasteners for the cover board or 2917 fasteners for the base layer (i.e., 24 fasteners per board)), as well as at least 26,666 square feet of adhesive.

By contrast, FIGS. 4C and 4D illustrate roofing systems according to embodiments of the invention (e.g., inverted tapered roofing systems). In the embodiment of FIG. 4C, an inverted tapered roofing system 900 is provided that is a four-by-eight panel or base layer system on top (i.e., inverted) with a cover board and a four-by-eight fill layer for a ¼" slope roof having tapered insulation (e.g., a standard panel repeat). As shown in FIG. 4C, the roofing system 900 includes a plurality of non-tapered insulation panels (e.g., 4" non-tapered ISO or composite ISO foam boards) 910 that is sandwiched between a top membrane layer or cover board 930 and a plurality of tapered insulation panels (e.g., tapered ISO foam boards) 920A, 920B, 920C, 920D, and 920E on the bottom. The plurality of non-tapered insulation panels 910 has an upper surface 912 and a lower surface 914, with the lower surface 914 being applied onto an upper surface (described below) of the plurality of tapered insulation panels 920A, 920B, 920C, 920D, and 920E, and the upper surface 912 having the membrane layer or cover board 930 applied thereto. As further shown in the embodiment of FIG. 4C, a first set or plurality of tapered insulation panels 920A has an upper surface 921A and a lower surface 922A, with the lower surface 922A of the plurality of tapered insulation panels 920A being provided on a roof deck (not shown) and the upper surface 921A of the plurality of tapered insulation panels 920A being in contact with the lower surface 914 of the plurality of non-tapered insulation panels 910. As also shown in the embodiment of FIG. 4C, a second set or plurality of tapered insulation panels 920B has an upper surface 921B and a lower surface 922B, with the lower surface 922B of the plurality of tapered insulation panels 920B being provided on top of a first fill material 915A (e.g., one or more 2" fill materials or one or more 2" flat ISO foam boards or panels) and the upper surface 921B of the plurality of tapered insulation panels 920B being in contact with the lower surface 914 of the plurality of non-tapered insulation panels 910. As further shown in the embodiment of FIG. 4C, a third set or plurality of tapered insulation panels 920C has an upper surface 921C and a lower surface 922C, with the lower surface 922C of the plurality of tapered insulation panels 920C being provided on top of (i) a second fill material 915B (e.g., one or more 2" fill materials or one or more 2" flat ISO foam boards or panels) and (ii) the first fill material 915A (e.g., one or more 2" fill materials or one or more 2" flat ISO foam boards or panels), and the upper surface 921C of the plurality of tapered insulation panels 920C being in contact with the lower surface 914 of the plurality of non-tapered insulation panels 910. As shown in the embodiment of FIG. 4C, a fourth set or plurality of tapered insulation panels 920D has an upper surface 921D and a lower surface 922D, with the lower surface 922D of the plurality of tapered insulation panels 920D being provided on top of (i) a third fill material 915C (e.g., one or more 2" fill materials or one or more 2" flat ISO foam boards or panels), (ii) the second fill material 915B (e.g., one or more 2" fill materials or one or more 2" flat ISO foam boards or panels), and (iii) the first fill material 915A (e.g., one or more 2" fill materials or one or more 2" flat ISO foam boards or panels), and the upper surface 921D of the plurality of tapered insulation panels 920D being in contact with the lower surface 914 of the plurality of non-tapered insulation panels 910. As also shown in the embodiment of FIG. 4C, a fifth set or one or more tapered insulation panels 920E has an upper surface 921E and a lower surface 922E, with the lower surface 922E of the one or more tapered insulation panels 920E being provided on top of (i) a fourth fill material 915D (e.g., one or more 2" fill materials or one or more 2" flat ISO foam boards or panels), (ii) the third fill material 915C (e.g., one or more 2" fill materials or one or more 2" flat ISO foam boards or panels), (iii) the second fill material 915B (e.g., one or more 2" fill materials or one or more 2" flat ISO foam boards or panels), and (iv) the first fill material 915A (e.g., one or more 2" fill materials or one or more 2" flat ISO foam boards or panels), and the upper surface 921E of the one or more tapered insulation panels 920E being in contact with the lower surface 914 of the plurality of non-tapered insulation panels 910. The system and method of FIG. 4C requires at least 1666 panels to be purchased and installed, which is less than the prior art system and method shown in FIG. 4A. The system and method of FIG. 4C further requires at least the same amount of fasteners to be used to secure (e.g., mechanically attach) the membrane or cover board to the roof deck (e.g., 1563 fasteners for the cover board (i.e., 24 fasteners per board)) or 3241 fasteners to mechanically fasten the base layer, as well as at least 27,778 square feet of adhesive.

FIG. 4D illustrates a roofing system according to another embodiment of the invention (e.g., an inverted tapered roofing system). In the embodiment of FIG. 4D, an inverted tapered roofing system 1000 is provided that is a four-by-eight panel or base layer system on top (i.e., inverted) with a cover board and a four-by-eight fill layer for a ¼" slope roof having tapered insulation (e.g., an extended panel repeat). As shown in FIG. 4D, the roofing system 1000 includes a plurality of non-tapered insulation panels (e.g., 4" non-tapered ISO or ISO composite foam boards) 1010 that is sandwiched between a top membrane layer or cover board 1030 and a plurality of tapered insulation panels (e.g., tapered ISO foam boards) 1020A, 1020B, and 1020C on the bottom. The plurality of non-tapered insulation panels 1010 has an upper surface 1012 and a lower surface 1014, with the lower surface 1014 being applied onto an upper surface (described below) of the plurality of tapered insulation panels 1020A, 1020B, and 1020C, and the upper surface 1012 having the membrane layer or cover board 1030 applied thereto. As further shown in the embodiment of FIG. 4D, a first set or plurality of tapered insulation panels 1020A has an upper surface 1021A and a lower surface 1022A, with the lower surface 1022A of the plurality of tapered insulation panels 1020A being provided on a roof deck (not shown) and the upper surface 1021A of the plurality of tapered insulation panels 1020A being in contact with the lower surface 1014 of the plurality of non-tapered insulation panels 1010. As also shown in the embodiment of FIG. 4D, a second set or plurality of tapered insulation panels 1020B has an upper surface 1021B and a lower surface 1022B, with the lower surface 1022B of the plurality of tapered insulation panels 1020B being provided on top of a first fill material 1015A (e.g., two, 4" fill materials or two, 4" flat ISO foam boards or panels) and the upper surface 1021B of the plurality of tapered insulation panels 1020B being in contact with the lower surface 1014 of the plurality of non-tapered insulation panels 1010. As further shown in the embodiment of FIG. 4D, a third set or one or more tapered insulation panels 1020C has an upper surface 1021C and a lower surface 1022C, with the lower surface 1022C of the one or more tapered insulation panels 1020C being provided on top of (i) a second fill material 1015B (e.g., one or more 4" fill materials or one or more 4" flat ISO foam boards or panels) and (ii) the first fill material 1015A (e.g., one or more 4" fill materials or one or more 4" flat ISO foam boards or panels), and the upper surface 1021C of the one or more tapered insulation panels 1020C being in contact with the lower surface 1014 of the plurality of non-tapered insulation panels 1010. The system and method of FIG. 4D requires at least 1250 panels to be purchased and installed, which is less than the prior art system and method shown in FIG. 4A and/or FIG. 4B. The system and method of FIG. 4D further requires an equal amount of fasteners to be used to secure (e.g., mechanically attach) the cover board to the roof deck (e.g., 1563 fasteners for the cover board (i.e., 24 fasteners per board)) or 3241 fasteners to mechanically fasten the base layer, as well as at least 16,667 square feet of adhesive.

As shown in the Table of FIG. 5, the physical characteristics, e.g., slope, thickness, size, etc., of various tapered insulation panels (e.g., X, Y, Z, etc.), which represent some of the tapered insulation panels illustrated in the embodiments of FIGS. 3C, 3D, 4C and 4D, are illustrated, along with their shipping information, according to some embodiments of the invention. The Tables of FIGS. 6A and 6B further illustrate the number of fasteners for mechanically attached systems and adhered systems, respectively, having tapered insulation, such as those systems illustrated in FIGS. 3C, 3D, 4C and 4D, depending on, e.g., the insulation type (e.g., polyiso, perlite, extruded polystyrene, expanded polystyrene, gypsum board, wood fiber, etc.), board or panel size, and thickness, according to some embodiments of the invention. According to an embodiment, the fasteners can be applied in a certain pattern(s) to the inverted tapered roofing systems described herein.

Another embodiment of this invention pertains to a roof assembly kit that includes a plurality of tapered insulation panels, wherein the plurality of tapered insulation panels is configured to be installed onto a roof deck of a low slope roof, at least one non-tapered insulation panel having an upper surface and a lower surface, wherein the lower surface of the at least one non-tapered insulation panel is configured to be installed onto the plurality of tapered insulation panels, a membrane layer having an upper surface and a lower surface, wherein the membrane layer is configured to be installed onto the upper surface of the at least one non-tapered insulation panel, and instructions for installation of (i) the plurality of tapered insulation panels on the roof deck, (ii) the at least one non-tapered insulation panel on the plurality of tapered insulation panels, and (iii) the membrane layer on the at least one non-tapered insulation panel, such that the upper surface of the membrane layer is exposed.

In one embodiment, the roof assembly kit further comprises a plurality of fasteners configured to be installed through the membrane layer, the at least one non-tapered insulation panel, and the plurality of tapered insulation panels into the roof deck.

Another embodiment of this invention pertains to a method that includes obtaining a plurality of tapered insulation panels, the plurality of tapered insulation panels having an upper surface and a lower surface, obtaining at least one non-tapered insulation panel having an upper surface and a lower surface, obtaining a membrane layer having an upper surface and a lower surface, obtaining instructions for installation, applying the plurality of tapered insulation panels onto a roof deck in accordance with the instructions for installation, (c) applying the at least one non-tapered insulation panel onto the plurality of tapered insulation panels, such that the lower surface of the at least one non-tapered insulation panel is applied onto the upper surface of the plurality of tapered insulation panels, in accordance with the instructions for installation, and applying the membrane layer to the upper surface of the at least one non-tapered insulation panel, such that the upper surface of the membrane layer is exposed and the lower surface of the membrane layer is applied onto the upper surface of the at least one non-tapered insulation panel, in accordance with the instructions for installation.

In one embodiment, the method further comprises installing a plurality of fasteners through the membrane layer, the at least one non-tapered insulation panel, and the plurality of tapered insulation panels into the roof deck. In one embodiment, the installing of the plurality of fasteners is conducted by installing the plurality of fasteners in a certain pattern.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

The invention claimed is:

1. A roofing system comprising:

a roof deck;

a plurality of tapered insulation panels applied onto the roof deck, with each tapered insulation panel of the plurality of tapered insulation panels having an upper surface, a lower surface, a first side surface that extends from the upper surface to the lower surface, and a second side surface that is opposite to the first side surface and extends from the upper surface to the lower surface, wherein each tapered insulation panel of the plurality of tapered insulation panels comprises an individually formed, tapered polyisocyanurate foam panel that extends uniformly from (i) the upper surface to the lower surface and (ii) the first side surface to the second side surface;

at least one non-tapered insulation panel applied onto the upper surface of each tapered insulation panel of the plurality of tapered insulation panels, with the at least one non-tapered insulation panel having an upper surface and a lower surface, with the lower surface of the at least one non-tapered insulation panel being applied onto the upper surface of each tapered insulation panel of the plurality of tapered insulation panels, wherein the at least one non-tapered insulation panel comprises a non-tapered polyisocyanurate foam panel; and a membrane layer applied onto the upper surface of the at least one non-tapered insulation panel, with the membrane layer having an upper surface and a lower surface, with the lower surface of the membrane layer being applied onto the upper surface of the at least one non-tapered insulation panel, wherein the membrane layer comprises at least one of (i) a single-ply TPO membrane, (ii) a single-ply PVC membrane, (iii) an ethylene propylene diene terpolymer membrane (EPDM), (iv) a modified bitumen roofing layer, or (v) a built-up roofing (BUR) layer, wherein the roofing system is applied in accordance with instructions for installation, such that (i) the plurality of tapered insulation panels are applied onto the roof deck, (ii) the at least one non-tapered insulation panel is applied onto the upper surface of each tapered insulation panel of the plurality of tapered insulation panels, and (iii) the membrane layer is applied onto the upper surface of the at least one non-tapered insulation panel, such that the upper surface of the membrane layer is exposed.

2. The roofing system according to claim 1, further comprising a plurality of fasteners installed through the membrane layer, the at least one non-tapered insulation panel, and the plurality of tapered insulation panels into the roof deck.

3. The roofing system according to claim 1, further comprising a substrate applied onto the roof deck.

4. The roofing system according to claim 1, wherein the membrane layer has a thickness of 40 mils to 140 mils.

5. The roofing system according to claim 1, wherein one or more tapered insulation panels of the plurality of tapered insulation panels comprises (i) a different thickness, (ii) a different slope, or (iii) a combination of (i) and (ii).

6. The roofing system according to claim 1, wherein the at least one non-tapered insulation panel has a thickness of 0.5 inches to 4.5 inches.

7. The roofing system according to claim 1, wherein the roofing system comprises a low slope roof.

8. A roof assembly kit comprising:

a plurality of tapered insulation panels, wherein the plurality of tapered insulation panels is configured to be installed onto a roof deck of a low slope roof, with each tapered insulation panel of the plurality of tapered insulation panels having an upper surface, a lower surface, a first side surface that extends from the upper surface to the lower surface, and a second side surface that is opposite to the first side surface and extends from the upper surface to the lower surface, wherein each tapered insulation panel of the plurality of tapered insulation panels comprises an individually formed, tapered polyisocyanurate foam panel that extends uniformly from (i) the upper surface to the lower surface and (ii) the first side surface to the second side surface;

at least one non-tapered insulation panel having an upper surface and a lower surface, wherein the lower surface of the at least one non-tapered insulation panel is configured to be installed onto the upper surface of each tapered insulation panel of the plurality of tapered insulation panels, wherein the at least one non-tapered insulation panel comprises a non-tapered polyisocyanurate foam panel;

a membrane layer having an upper surface and a lower surface, wherein the membrane layer is configured to be installed onto the upper surface of the at least one non-tapered insulation panel, wherein the membrane layer comprises at least one of (i) a single-ply TPO membrane, (ii) a single-ply PVC membrane, (iii) an ethylene propylene diene terpolymer membrane (EPDM), (iv) a modified bitumen roofing layer, or (v) a built-up roofing (BUR) layer; and instructions for installation of (i) the plurality of tapered insulation panels on the roof deck, (ii) the at least one non-tapered insulation panel on the plurality of tapered insulation panels, and (iii) the membrane layer on the at least one non-tapered insulation panel, such that the upper surface of the membrane layer is exposed.

9. The roof assembly kit according to claim 8, further comprising a plurality of fasteners configured to be installed through the membrane layer, the at least one non-tapered insulation panel, and the plurality of tapered insulation panels into the roof deck.

10. A method comprising:

obtaining a plurality of tapered insulation panels, with each tapered insulation panel of the plurality of tapered insulation panels having an upper surface, a lower surface, a first side surface that extends from the upper surface to the lower surface, and a second side surface that is opposite to the first side surface and extends from the upper surface to the lower surface, wherein each tapered insulation panel of the plurality of tapered insulation panels comprises an individually formed, tapered polyisocyanurate foam panel that extends uniformly from (i) the upper surface to the lower surface and (ii) the first side surface to the second side surface;

obtaining at least one non-tapered insulation panel having an upper surface and a lower surface, wherein the at least one non-tapered insulation panel comprises a non-tapered polyisocyanurate foam panel;

obtaining a membrane layer having an upper surface and a lower surface, wherein the membrane layer comprises at least one of (i) a single-ply TPO membrane, (ii) a single-ply PVC membrane, (iii) an ethylene propylene diene terpolymer membrane (EPDM), (iv) a modified bitumen roofing layer, or (v) a built-up roofing (BUR) layer;

obtaining instructions for installation;

applying the plurality of tapered insulation panels onto a roof deck in accordance with the instructions for installation;

applying the at least one non-tapered insulation panel onto the plurality of tapered insulation panels, such that the lower surface of the at least one non-tapered insulation panel is applied onto the upper surface of each tapered insulation panel of the plurality of tapered insulation panels, in accordance with the instructions for installation; and applying the membrane layer to the upper surface of the at least one non-tapered insulation panel, such that the upper surface of the membrane layer is exposed and the lower surface of the membrane layer is applied onto the upper surface of the at least one non-tapered insulation panel, in accordance with the instructions for installation.

11. The method according to claim 10, further comprising installing a plurality of fasteners through the membrane layer, the at least one non-tapered insulation panel, and the plurality of tapered insulation panels into the roof deck.

* * * * *